United States Patent [19]

Ferguson

[11] Patent Number: 4,836,622

[45] Date of Patent: Jun. 6, 1989

[54] DISPLAY CABINET

[76] Inventor: John W. Ferguson, 193 Prospect St., Wynnum North, Queensland, Australia, 4178

[21] Appl. No.: 146,545

[22] Filed: Jan. 21, 1988

[30] Foreign Application Priority Data

Jan. 21, 1987 [AU] Australia ..... PH9955

[51] Int. Cl.[4] ..... A47F 3/00

[52] U.S. Cl. ..... 312/114; 108/92; 211/128

[58] Field of Search ..... 312/114, 138 R, 116; 211/128, 134; 108/92

[56] References Cited

U.S. PATENT DOCUMENTS

| | | | |
|---|---|---|---|
| 162,990 | 4/1951 | Roeder | 211/128 X |
| 1,063,961 | 6/1913 | Dreyer | 108/92 |
| 2,169,721 | 8/1939 | Cederquist | 211/128 |
| 4,121,377 | 10/1978 | Allen et al. | 108/92 X |

FOREIGN PATENT DOCUMENTS

| | | | |
|---|---|---|---|
| 233348 | 8/1987 | European Pat. Off. | 312/116 |
| 2208305 | 9/1973 | Fed. Rep. of Germany | 312/116 |
| 2554337 | 5/1985 | France | 312/116 |
| 317725 | 11/1954 | Switzerland | 211/128 |

*Primary Examiner*—Joseph Falk

*Attorney, Agent, or Firm*—Foley & Lardner, Schwartz, Jeffery, Schwaab, Mack, Blumenthal & Evans

[57] ABSTRACT

A display cabinet has a series of rigidly interconnected similar parallel frames, each including a standard set back from the front of the cabinet and inclining rearwardly to its top. The standards carry supports for shelves located between frames, their fronts in a plane parallel to the standards. Glass front panels, their main lower parts in front of and inclined parallel to the standards are supported closely adjacent by a transverse channel in which their bottom edges are pivotally engaged so each can be swung forwards to open position, or back to normal closed position when their upper parts, which are rearwardly curved, come to rest on a counter mounted on the frames, means being provided for releasably holding the front panels in closed position.

4 Claims, 1 Drawing Sheet

DISPLAY CABINET

BACKGROUND OF THE INVENTION

1. Field of the Invention

This invention relates to an improved display cabinet.

2. Prior Art

Display or holding cabinets for bakery products, for example, are well known and widely used, such a cabinet commonly having a glass front and a counter top, which may also be of glass, between end frames which are provided with supports for glass or other shelves within the cabinet, which is generally internally illuminated. It is usual for such a display or holding cabinet to be of multiple type consisting of a number of co-joined units which are separated by intermediate frames substantially identical with the end frames. An arrangement of this type, though generally effective, has the disadvantage that the end and intermediate frames cause discontinuities in the overall appearance of the assembly, reducing its visual appeal and also markedly interfering with the clear presentation of the goods displayed on the shelves.

SUMMARY OF THE INVENTION

The present invention has been devised with the general object of providing a display or holding cabinet which may be of multiple unit type and in which the visual appeal and the presentation of the contents are greatly enhanced.

With the foregoing and other objects in view the invention resides broadly in a display cabinet of the type having a plurality of generally similar upright frames rigidly interconnected in parallel spaced relationship, the frames supporting one or more transparent front panels and top or counter sections, and being provided with standards carrying supports for shelves, characterised in that:

the standards are set back from the front of the cabinet and incline rearwards from bottom to top, the shelf supports are fixed to the standards to support shelves which cantilever forwardly and rearwardly of the standard, their front edges substantially in a plane parallel to the standards, and the front panels are closely adjacent and, in front of the shelves, incline rearwards from bottom to top in a plane substantially parallel to the standards.

BRIEF DESCRIPTION OF THE DRAWINGS

In order that the invention may be readily understood and carried into practical effect, reference is now made to the accompanying drawings, wherein.

DETAILED DESCRIPTION OF THE PREFERRED EMBODIMENTS

Figure 2:
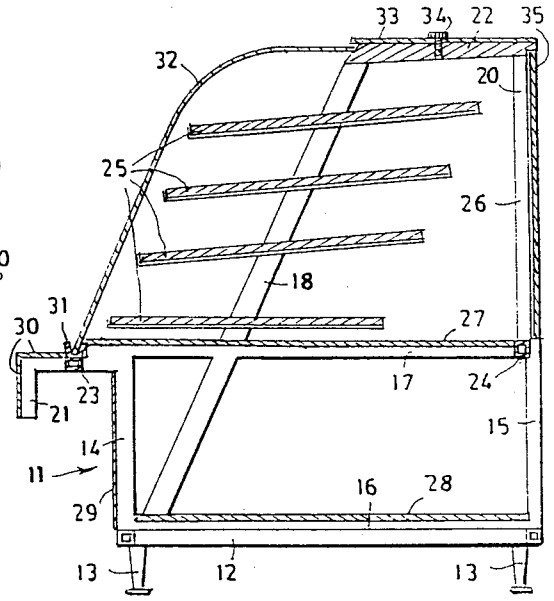
FIG. 2 is a cross-sectional view of the cabinet.

The display cabinet illustrated has a series of substantially similar end frames 10 and intermediate frames 11, all of which may be built-up of square or rectangular section metal tube. All of these frames are bolted or otherwise secured in equally spaced arrangement on a rectangular base frame 12, which is supported horizontally by a series of legs 13. Each of the frames 10 and 11 has front and back uprights 14 and 15 rigidly interconnected by bottom and intermediate horizontal members 16 and 17, an oblique standard 18, inclining upwardly towards the rear, extending from the front part of the bottom member 16, intersecting the intermediate member 17. At its top, the standard 18 joins the front of the horizontal top member 19, and a vertical strut 20 is fixed between the rear parts of the top member 19 and the intermediate member 17. Each of the frames has an angled bracket 21 extending forwardly and downwardly from the upper part of its front upright 14.

The end frames 10 and intermediate frames 11 are rigidly interconnected by counter pieces 22 between their top members 19 and by box-section connector tubes 23 and 24 secured between angle brackets 21 and the rear parts of intermediate members 17.

Between each pair of succeeding frames 10, 11 a series of shelves 25, preferably of glass, are mounted slidably from the rear, in pairs of angle shelf supports 26 which are welded or otherwise rigidly fixed to the oblique standards 18 to cantilever forwards and rearwards from the standard. These supports are fixed to one side only of the standard 18 of each end frame 10, and in pairs to both sides of the standard 18 of each intermediate frame 11.

In the embodiment illustrated the lowermost of each set of shelves 25 is horizontal, the others inclining downwardly to the front. The shelves are in a staggered arrangement so that their front edges lie more or less in a plane parallel to the oblique standards 18.

Between succeeding frames 10 and 11 table sections 27 are installed level with the tops of the intermediate horizontal members 17 and floor sections 28 are fitted level with the tops of the bottom members 16. A front panel 29 is fixed to the front uprights 14 of the series of frames, and sections 30 of sheet material mounted on the front and top of the angled brackets 21 form a parcels shelf for shoppers.

A continuous channel 31 is mounted on the brackets 21 and the front connector tubes 23 and supports a series of closely adjacent cabinet front panels 32 of glass. The main lower part of each panel is plane and towards its top it is curved arcuately towards the rear in cross-section and from this curved part it extends tangentially rearwards, the rear edge of its normally horizontal upper part resting on an oblique front edge of a lid piece 22. Counter tops 33 of glass or other suitable sheet material are held releasably on the counter pieces 22 and the top members 19 of the frames by screws 34, the front edges of the counter tops holding the front panels 32 in place by preventing their upper edges from lifting from the counter pieces 22. The glass front panels are so made and arranged that their main lower parts lie in a plane parallel to that in which lie the fronts of the shelves 25.

The back of the display cabinet may be closed by pairs of hinged doors 35, which may be of glass.

Appropriate lighting fittings (not shown) may be installed in the display cabinet, the tubular standards 18 serving as conduits for their electrical leads.

Each end frame 10 of the display cabinet may be closed by a glass panel (not shown) above the intermediate member 17 and by a panel (not shown) of any suitable sheet material below the member 17, or simply by being placed close to a wall structure.

As the aligned and closely adjacent front panels 32 of glass have their continuity unbroken by intervening front sections of frame structures, the cabinet has uncluttered appeal to the eye, and the bakery products or other goods contained in the assembly will be clearly and attractively presented to prospective customers. The staggered arrangement of the sloping shelves 25, their fronts in a plane parallel to the upwardly and rearwardly sloping front panels 32, facilitates the inspection of the goods on display.

Figure 1:
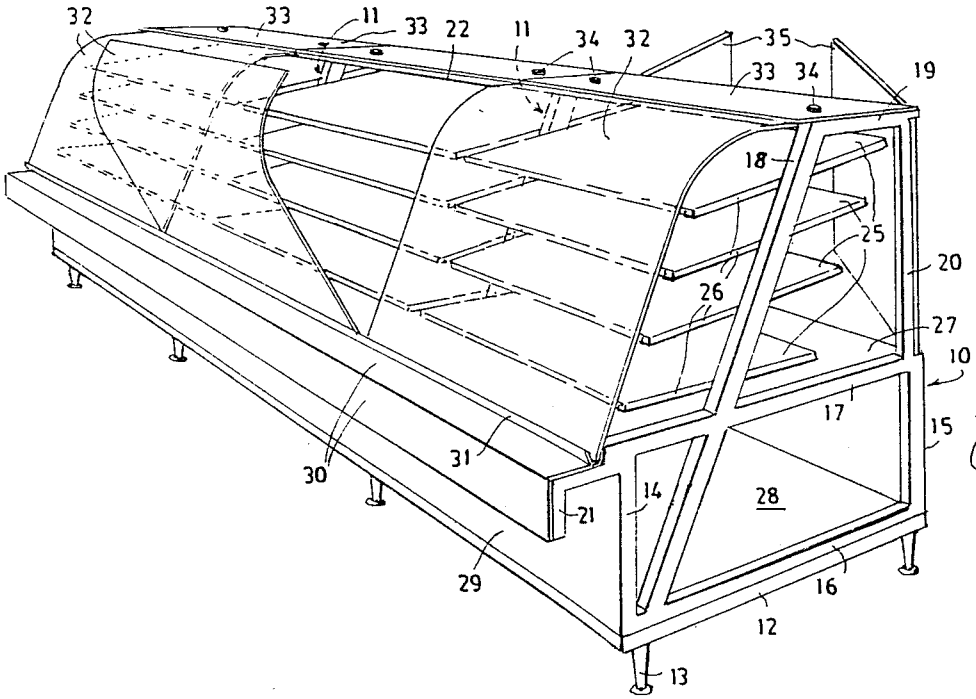
FIG. 1 is a perspective view of a display cabinet according to the invention.

The glass front panels may be easily and quickly moved from their normal positions to that shown in FIG. 1, in which the central front panel has been released, by slackening the screws 34 holding a counter top 33 to enable it to be lifted in front, releasing the top of the glass panel. The front panel 32 may then, as shown, by swung forwards to the limit imposed by the channel 31 in which its bottom is engaged, so that the inside surface of the panel may be readily cleaned. The shelves 25 may be slidably removed for cleaning after the rear doors 35 have been swung to their fully opened positions.

I claim:

1. A display cabinet comprising:

at least one transparent front panel;

at least one top section;

a plurality of generally similar upright frames rigidly interconnected in parallel spaced apart relationship supporting said front panel and said top section;

said frames including standards set back from the front of said cabinet and inclining rearwards from bottom to top;

means fixed to said standards for supporting shelf means;

shelf means supported in said support means, said shelf means being cantilevered forwardly and rearwardly of said standards, the front edges of said shelf means being aligned substantially in a plane parallel to said standards;

said transparent front panel being disposed in front of said shelf means and inclining rearwards from bottom to top in a plane substantially parallel to said standards.

2. A display cabinet according to claim 1 further comprising:

channel means mounted transversely of said frames, the bottom edges of said front panel being supported in said channel means to enable pivotal movement of said front panel between closed and opened positions, and retaining means for releasably holding said front panel in the closed position.

3. A display cabinet according to claim 2 further comprising:

a horizontal counter piece provided between said frames at the top thereof, a counter top removably secured on the counter piece by said retaining means and releasably engaging the top edge of the front panel;

the upper part of the front panel being curved towards the rear and resting on the front of the counter piece when the panel is in the closed position.

4. A display cabinet assembly comprising a plurality of display cabinets as set forth in claim 1.

* * * * *